US010923803B2

(12) United States Patent
Liu

(10) Patent No.: US 10,923,803 B2
(45) Date of Patent: Feb. 16, 2021

(54) LOOP ANTENNA SYSTEM AND MOBILE TERMINAL

(71) Applicant: AAC Technologies Pte. Ltd., Singapore (SG)

(72) Inventor: Feng Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 32 days.

(21) Appl. No.: 16/524,083

(22) Filed: Jul. 28, 2019

(65) Prior Publication Data

US 2020/0044313 A1 Feb. 6, 2020

(30) Foreign Application Priority Data

Aug. 3, 2018 (CN) ..... 201810878313.5

(51) Int. Cl.
*H01Q 1/24* (2006.01)
*H01Q 7/00* (2006.01)

(52) U.S. Cl.
CPC ..... *H01Q 1/243* (2013.01); *H01Q 7/00* (2013.01)

(58) Field of Classification Search
CPC H01Q 1/243; H01Q 7/00; H01Q 1/38; H01Q 1/48; H01Q 1/50
USPC ..... 343/702
See application file for complete search history.

(56) References Cited

U.S. PATENT DOCUMENTS 7,768,468 B2 * 8/2010 Gustafson ..... H01Q 21/30 343/750
10,186,755 B2 * 1/2019 Xiong ..... H01Q 5/50
2007/0008222 A1 * 1/2007 Wang ..... H01Q 1/243 343/700 MS
2012/0306707 A1 * 12/2012 Yang ..... H01Q 1/243 343/728
2013/0135164 A1 * 5/2013 Asanuma ..... H01Q 9/26 343/749
2014/0210675 A1 * 7/2014 Hwang ..... H01Q 1/48 343/702

(Continued)

FOREIGN PATENT DOCUMENTS

CN 101147294 A1 3/2008

OTHER PUBLICATIONS

1st Office Action dated Dec. 11, 2019 by SIPO in related Chinese Patent Application No. 201810878313.5 (6 Pages).

(Continued)

*Primary Examiner* — Don P Le
(74) *Attorney, Agent, or Firm* — W&G Law Group LLP

(57) ABSTRACT

The present disclosure provides a loop antenna system, including a back cover, a main board, a plastic back shell, and a loop antenna. The loop antenna including a first loop radiating unit, a second loop radiating unit, and a connecting member connecting the first loop radiating unit and the second loop radiating unit. Compared with the related technologies, the loop antenna system provided in the present disclosure has the following advantageous effects: by disposing a connecting member over an earphone base, the problem is solved that limitation to the thickness of a conventional entire structure results in that no bracket may be disposed over an earphone base, thereby eliminating the limitation to layout of an antenna by an earphone base. The present disclosure also provides a mobile terminal.

9 Claims, 6 Drawing Sheets

(56) References Cited

U.S. PATENT DOCUMENTS

| | | | | |
|---|---|---|---|---|
| 2015/0207211 | A1* | 7/2015 | Martiskainen | H01Q 1/243<br>343/702 |
| 2016/0233574 | A1* | 8/2016 | Xiong | H01Q 21/28 |
| 2017/0062932 | A1* | 3/2017 | Foster | H01Q 1/243 |
| 2018/0261921 | A1* | 9/2018 | Ha | H04M 1/0277 |
| 2020/0044313 | A1* | 2/2020 | Liu | H01Q 1/243 |

OTHER PUBLICATIONS

PCT search report dated Aug. 26, 2019 by SIPO in related PCT Patent Application No. PCT/CN2019/088236 (4 Pages).
The writing opinion dated Aug. 26, 2019 by SIPO in related PCT Patent Application No. PCT/CN2019/088236 (5 Pages).

* cited by examiner

LOOP ANTENNA SYSTEM AND MOBILE TERMINAL

TECHNICAL FIELD

The present disclosure relates to the field of antenna technology, especially a loop antenna system and a mobile terminal.

BACKGROUND

With rapid development of communication technology, requirements of a mobile terminal are increasingly diversified, and thus more and more are required of an antenna in a mobile terminal.

At present, with the limitation to thickness of an entire structure of a mobile terminal such as a mobile phone, a bracket for a formed antenna cannot be installed over an earphone hole, resulting in that antennas of some structures cannot be installed, and performance of the antenna will be worse if the bracket of the formed antenna is moved inward.

Therefore, it is necessary to provide a new loop antenna system to solve the above-described problem.

BRIEF DESCRIPTION OF THE DRAWINGS

In order to describe technical solutions in the embodiments of the present disclosure more clearly, accompany drawings used to describe the embodiments are briefly illustrated below. It is obvious that the drawings in the following description are only some embodiments of the present disclosure. For skilled persons in the art, in a case where no inventive effort is made, other drawings may be obtained according to these drawings, where.

DETAILED DESCRIPTION

The technical solutions in embodiments of the present disclosure will be clearly and completely described with reference to the accompany drawings of the present disclosure. It is obvious that the embodiments described are only some rather than all embodiments of the present disclosure. Based on the embodiments of the present disclosure, all other embodiments obtained by skilled persons in the art without making any inventive effort fall into the disclosure of protection by the present disclosure.

Figure 1:
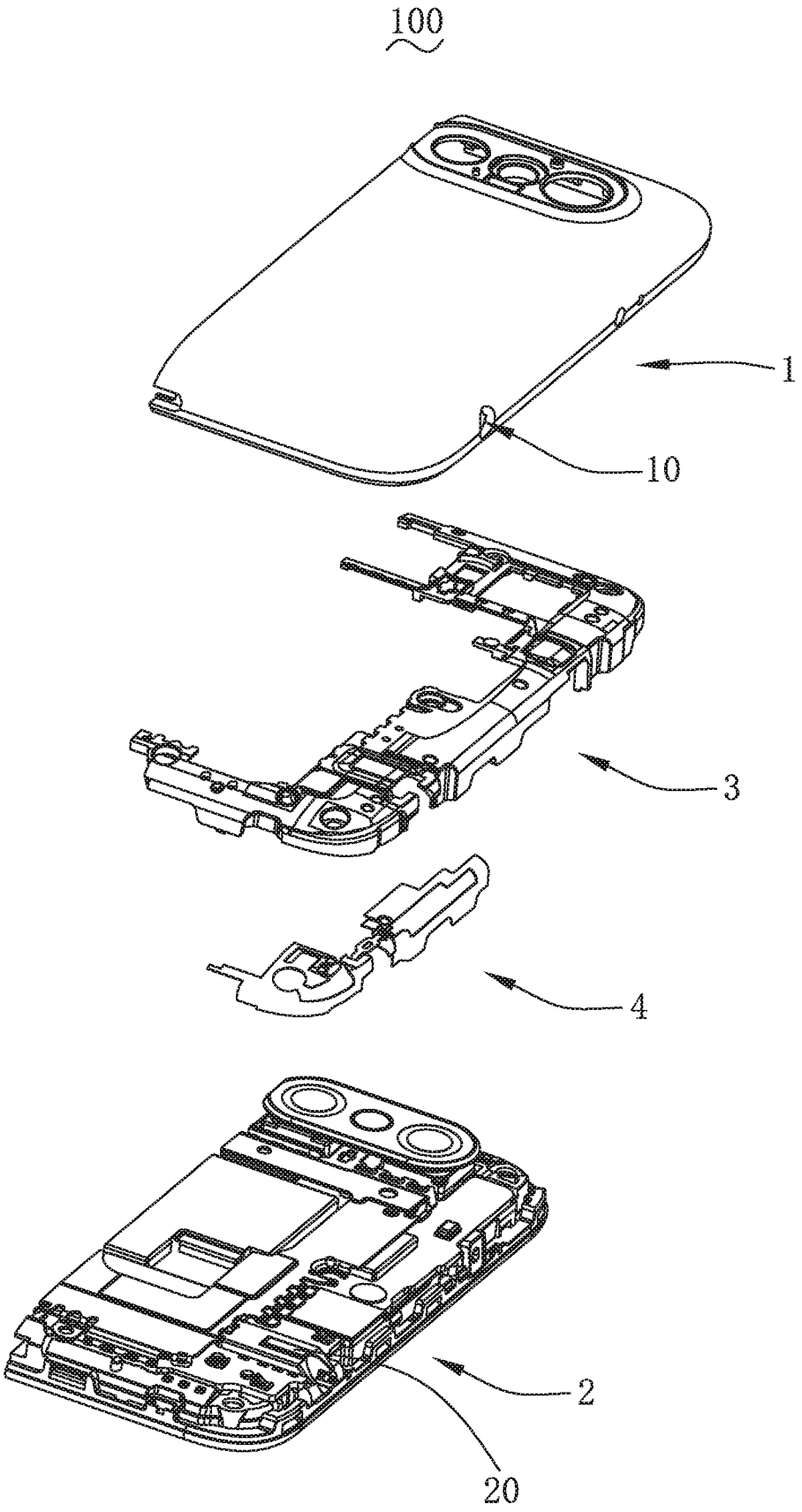
FIG. 1 is an exploded perspective view of a loop antenna system in the present disclosure.
Figure 2:
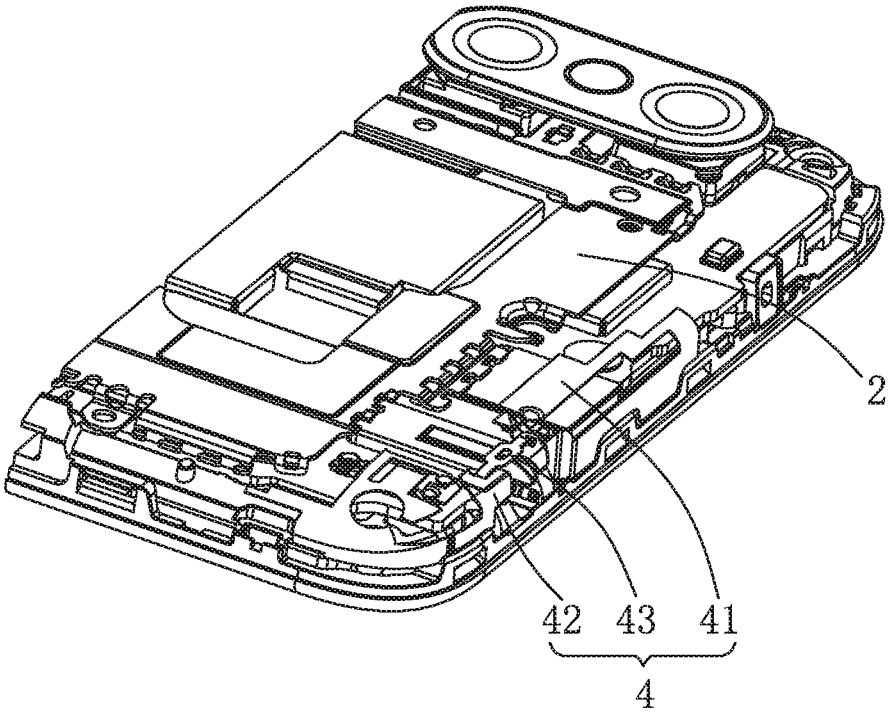
FIG. 2 is an perspective structural view of the loop antenna system in the present disclosure.

With reference to FIG. 1 and FIG. 2, an embodiment of the present disclosure provides a loop antenna system 100, including a back cover 1, a main board 2 accommodated inside the back cover 1, a plastic back shell 3 fixed to the main board 2 and located between the back cover 1 and the main board 2, and a loop antenna 4 disposed on the plastic back shell 3. A side wall of the back cover 1 is disposed with a socket 10 for an earphone contact to be plugged in. A position of the main board 2 corresponding to the socket 10 is disposed with an earphone base 20 for the earphone contact to be plugged in. A position of the plastic back shell 3 and a position of the loop antenna 4 that correspond to the earphone base 20 are both disposed with reserved space.

Figure 3:
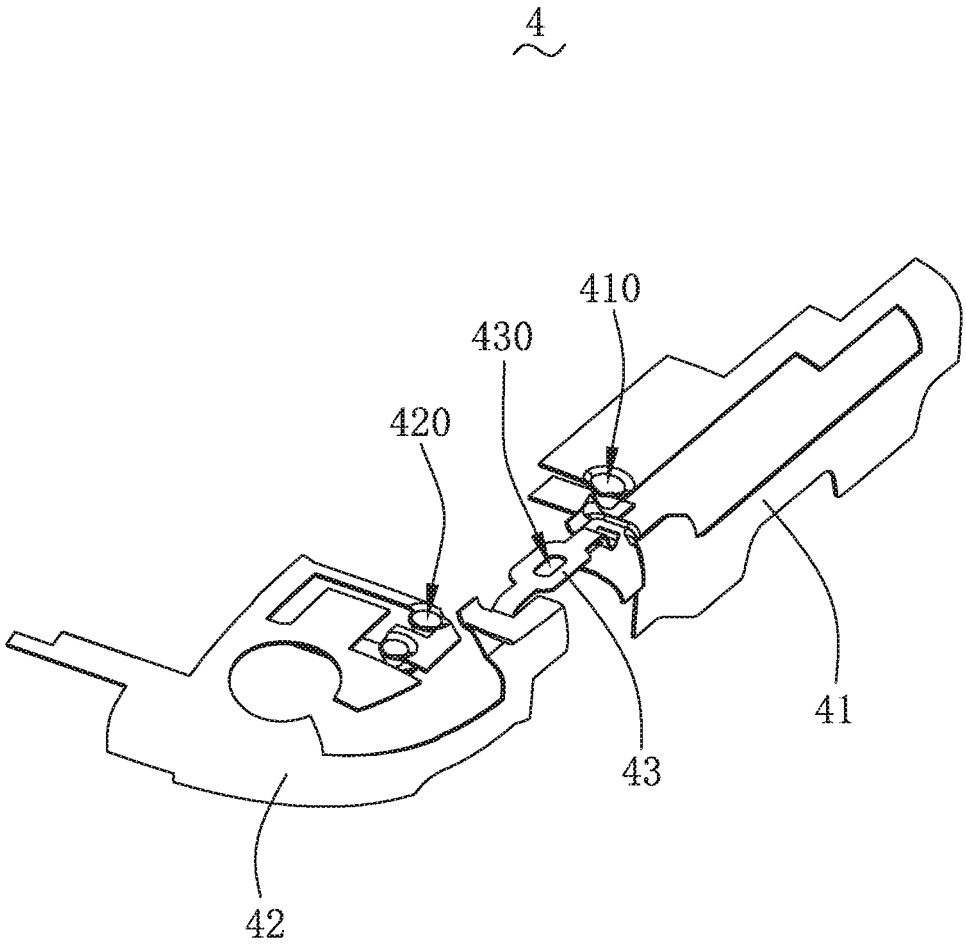
FIG. 3 is a perspective structural view of a loop antenna of the loop antenna system in the present disclosure.

Further, with reference to FIG. 3, operation frequency bands of the loop antenna 4 are 700-960 MHzs and 1710-2690 MHzs. The loop antenna specifically includes a first loop radiating unit 41 and a second loop radiating unit 42 which are disposed separately on both sides of the earphone base 20, and a connecting member 43 located between the first loop radiating unit 41 and the second loop radiating unit 42. The first loop radiating unit 41 is disposed with a ground feed point 410, and the second loop radiating unit 42 is disposed with a feed point 420 electrically connected to an antenna feed circuit on the main board 2.

In a preferable embodiment of the present disclosure, both the first loop radiating unit 41 and the second loop radiating unit 42 are half-closed structures with an opening, and the opening of the first loop radiating unit 41 and the opening of the second loop radiating unit 42 are opposite to each other. In a preferable embodiment of the present disclosure, the first loop radiating unit 41 and the second loop radiating unit 42 are disposed at the plastic back shell 4 through an LDS processing.

The connecting member 43 is fixed at the back cover 1 with two opposite ends of the connecting member 43 respectively connecting the first loop radiating unit 41 and the second loop radiating unit 42. In a preferable embodiment of the present disclosure, the two opposite ends of the connecting member 43 respectively elastically connect to the first loop radiating unit 41 and to the second loop radiating unit 42. The connecting member 43 is disposed over and across the earphone base 20, thereby avoiding limitation to layout of the antenna by the earphone base 20.

In a preferable embodiment of the present disclosure, the feed point 420 is disposed at an end of the second loop radiating unit 42 away from the connecting member 43, and the ground feed point 410 is disposed at an end of the first loop radiating unit 41 away from the connecting member 43.

Figure 4:
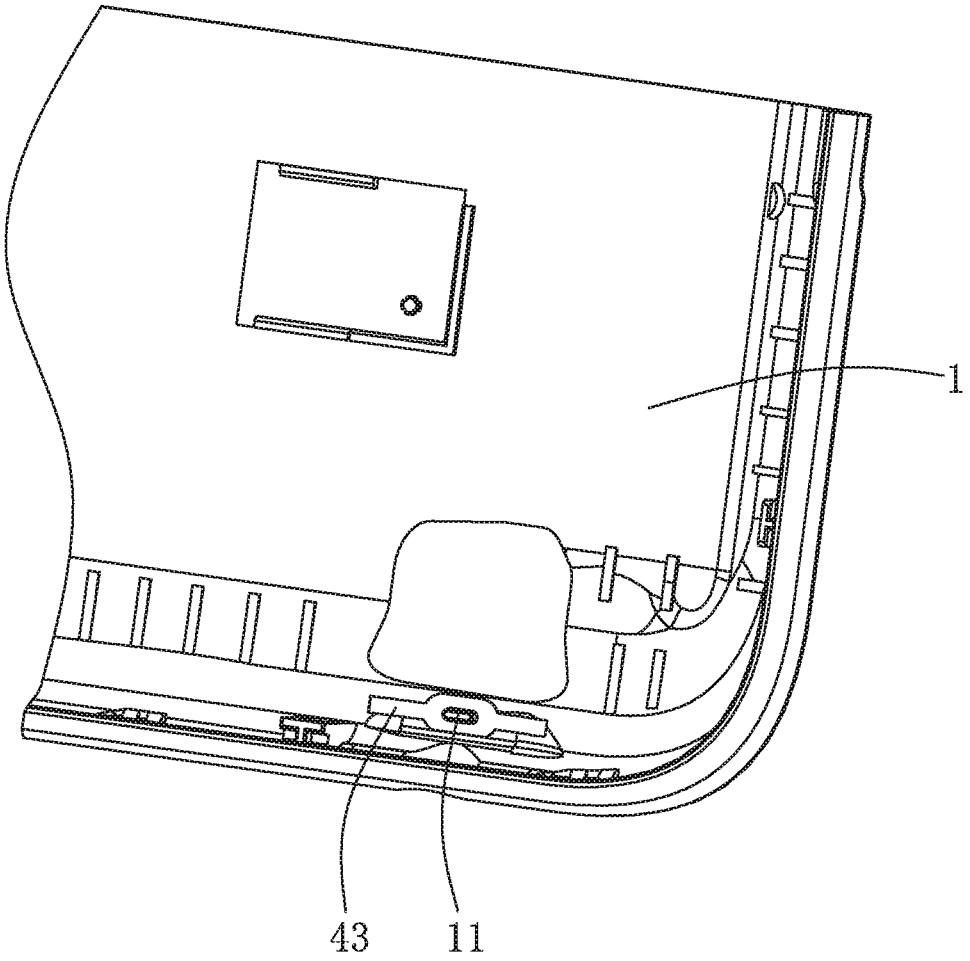
FIG. 4 is a structural view of a back cover and a connecting member in the loop antenna system in the present disclosure.

Further, with reference to FIG. 4, the connecting member 43 is disposed with a clasp hole 430, a position of the back cover 1 corresponding to the connecting member 43 is disposed with a protruding pillar 11 matching the clasp hole 430. The protruding pillar 11 matches the clasp hole 430 so that the connecting member 43 is fixed to the back cover 1. Specifically, the protruding pillar 11 is hot melt so that the connecting member 43 is fixed tightly to the back cover 1.

The main board 2 corresponding to the ground feed point 420 provided with a ground switch (not shown) connected to the ground feed point 420. It is natural that the main board 2 is further installed with other electronic elements such as a loudspeaker, a microphone, a USB interface, a motor and the like.

Figure 5:
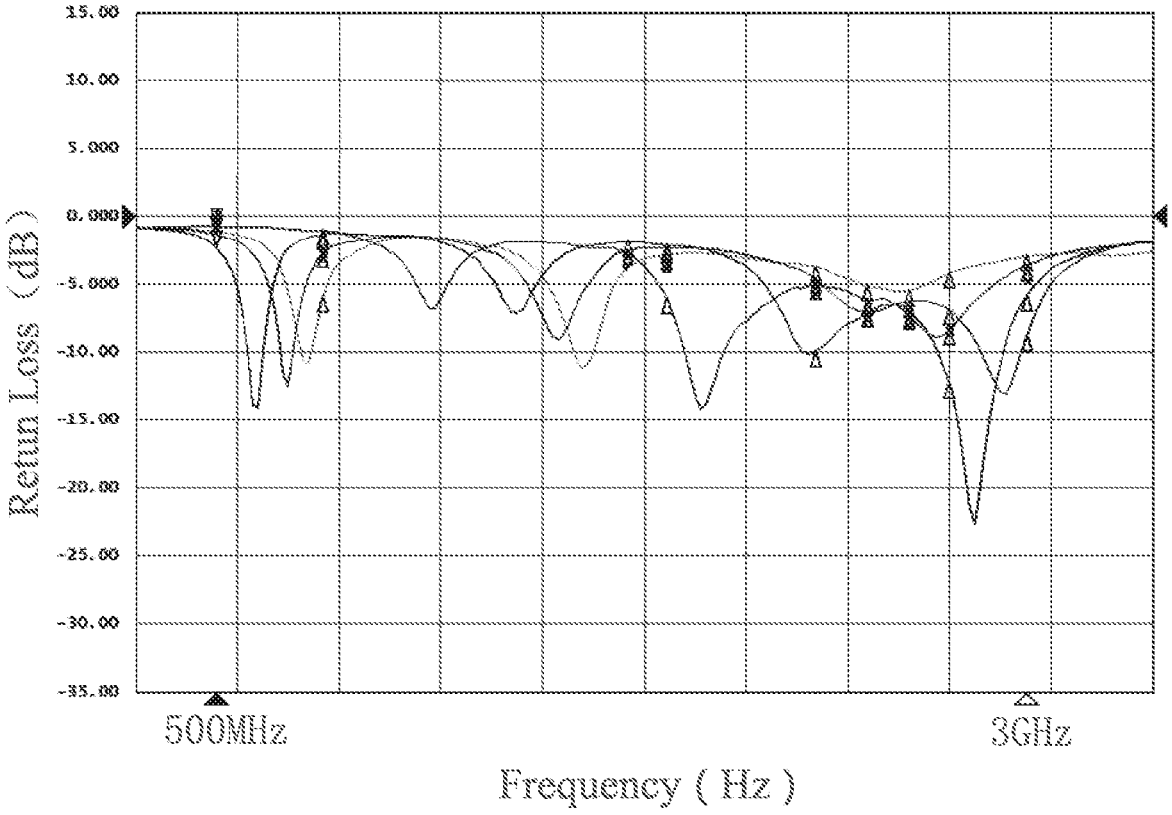
FIG. 5 is a diagram showing return loss of the loop antenna system in the present disclosure.
Figure 6:
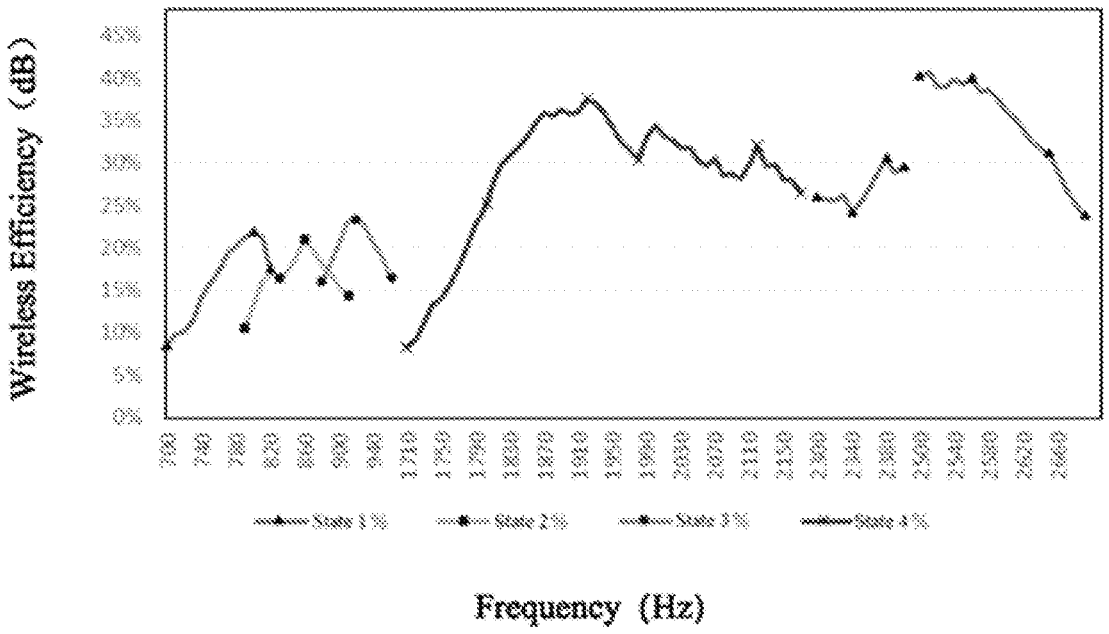
FIG. 6 is a diagram showing antenna efficiency of the loop antenna system in the present disclosure.

A frequency modulation switch is configured to modulate antenna frequency drift. Specifically, as shown in FIG. 5, the ground switch modulates four frequency bands. Specifically, as shown in FIG. 6, when the operation frequency bands of the loop antenna 4 are 700-960 MHzs and 1710-2690 MHzs, antenna efficiency meets a requirement on antenna performance.

The present disclosure further provides a mobile terminal including the loop antenna system 100.

Compared with the related technologies, the loop antenna system provided in the present disclosure has the following advantageous effects: by disposing a connecting member over an earphone base, the problem is solved that limitation to the thickness of a conventional entire structure results in that no bracket for a formed antenna may be disposed over an earphone base, thereby eliminating limitation to layout of an antenna by an earphone base.

The above-described are only embodiments of the present disclosure. It shall be noted that skilled persons in the related art may make improvements without departing from the concept of the present disclosure. All these improvements fall into the protection scope of the present disclosure.

What is claimed is:

1. A loop antenna system, comprising a back cover, a main board accommodated in the back cover, a plastic back shell fixed to the main board and located between the back cover and the main board, and an earphone base disposed on the main board, wherein the loop antenna system further comprises a loop antenna disposed on the surface of the plastic back shell right opposite the back cover, the loop antenna comprises a first loop radiating unit and a second loop radiating unit which are disposed separately on both sides of the earphone base, and a connecting member disposed over and across the earphone base and connecting the first loop radiating unit and the second loop radiating unit, the first loop radiating unit is provided with a ground feed point, the second loop radiating unit is provided with a feed point electrically connected to an antenna feed circuit on the main board, the main board corresponding to the ground feed point provided with a ground switch connected to the ground feed point, and the connecting member is fixed at the back cover with two opposite ends of the connecting member respectively connecting the first loop radiating unit and the second loop radiating unit.

2. The loop antenna system according to claim 1, wherein the feed point is disposed at an end of the second loop radiating unit away from the connecting member, and the ground feed point is disposed at an end of the first loop radiating unit away from the connecting member.

3. The loop antenna system according to claim 1, wherein both the first loop radiating unit and the second loop radiating unit are half-closed structures with an opening, and the opening of the first loop radiating unit and the opening of the second loop radiating unit are opposite to each other.

4. The loop antenna system according to claim 1, wherein operation frequency bands of the loop antenna are 700-960 MHzs and 1710-2690 MHzs.

5. The loop antenna system according to claim 1, wherein the two opposite ends of the connecting member respectively elastically connect to the first loop radiating unit and to the second loop radiating unit.

6. The loop antenna system according to claim 1, wherein the first loop radiating unit and the second loop radiating unit are disposed at the plastic back shell through an LDS processing.

7. The loop antenna system according to claim 1, wherein the connecting member is disposed with a clasp hole, a position of the back cover corresponding to the connecting member is disposed with a protruding pillar matching the clasp hole, and the connecting member is fixed to the back cover through the matching of the protruding pillar with the clasp hole.

8. A mobile terminal, comprising the loop antenna system according to claim 1.

9. A mobile terminal, comprising the loop antenna system according to claim 2.

* * * * *